US007980999B2

(12) United States Patent
Kawaguchi et al.

(10) Patent No.: US 7,980,999 B2
(45) Date of Patent: Jul. 19, 2011

(54) BODY MOTION DISCRIMINATING APPARATUS AND ACTIVITY MONITOR

(75) Inventors: Kaori Kawaguchi, Kyoto (JP); Yoshitake Oshima, Kyoto (JP)

(73) Assignee: Omron Healthcare Co., Ltd., Kyoto (JP)

( * ) Notice: Subject to any disclaimer, the term of this patent is extended or adjusted under 35 U.S.C. 154(b) by 46 days.

(21) Appl. No.: 12/543,185

(22) Filed: Aug. 18, 2009

(65) Prior Publication Data

US 2010/0069203 A1 Mar. 18, 2010

(30) Foreign Application Priority Data

Sep. 18, 2008 (JP) ..... 2008-238850

(51) Int. Cl.
*A63B 71/00* (2006.01)

(52) U.S. Cl. ..... 482/8; 482/1; 482/901; 702/160

(58) Field of Classification Search ..... 482/1–9, 482/900–902; 434/247; 702/127, 141, 160
See application file for complete search history.

(56) References Cited

U.S. PATENT DOCUMENTS 6,941,239 B2 * 9/2005 Unuma et al. ..... 702/141
7,616,153 B2 * 11/2009 Honda et al. ..... 342/357.74
7,653,508 B1 * 1/2010 Kahn et al. ..... 702/160

FOREIGN PATENT DOCUMENTS

JP 07-178073 A 7/1995

OTHER PUBLICATIONS

Patent Abstracts of Japan, Publication No. 07-178073, Publication Date: Jul. 18, 1995, 1 page.

* cited by examiner

*Primary Examiner* — Glenn Richman
(74) *Attorney, Agent, or Firm* — Osha • Liang LLP

(57) ABSTRACT

A body motion discriminating apparatus includes an acceleration sensor for detecting a body motion of a user, a storing unit for storing a threshold, a threshold changing unit for changing the threshold based on physical data expressing a physical feature of the user and registering the changed threshold in the storing unit, and a discriminating unit for discriminating whether a detected body motion is walking or running by comparing a value of a parameter calculated from amplitude and cycle of an output signal of the acceleration sensor with the threshold.

7 Claims, 7 Drawing Sheets

BODY MOTION DISCRIMINATING APPARATUS AND ACTIVITY MONITOR

BACKGROUND OF THE INVENTION

1. Field of the Invention

The present invention relates to a technique for discriminating walking and running from each other by an acceleration sensor.

2. Description of the Related Art

Methods of automatically discriminating whether a user (subject) is in a walking state or a running state by an acceleration sensor attached to the body have been being studied. A technique of this kind is applied to, for example, an apparatus for measuring a quantity of exercise (step count, energy expenditure (consumption), or the like) or an intensity of exercise (METs or the like) (pedometer, activity monitor, or the like) and an apparatus for recording/managing a physical activity of a subject in a hospital or a rehabilitation facility. ("METs" is a unit of metabolic equivalent.)

In Japanese Patent Application Laid-Open No. 7-178073, a method of extracting an AC component in an output signal of an acceleration sensor and discriminating walking and running from each other based on the frequency and amplitude of the AC component is proposed. Certainly, during running, the pitch is higher and a vertical motion of the body is larger than those during walking. Consequently, as a general tendency, the frequency of an acceleration waveform is higher and the amplitude is larger. However, since the frequency and the value of the amplitude which change from the walking state to the running state vary among individuals, in the case of a conventional uniform discriminating method, there is the possibility that the discrimination ratio markedly drops depending on a user.

SUMMARY OF THE INVENTION

The present invention has been achieved in view of the above-described circumstances and an object of the invention is to provide a technique capable of precisely discriminating walking and running from each other based on an output signal of an acceleration sensor in consideration of individual differences such as differences in physical attributes.

To achieve the object, the present invention employs the following configuration.

A first aspect of the present invention relates to a body motion discriminating apparatus including an acceleration sensor for detecting a physical activity (body motion) of a user, a storing unit for storing a threshold, a threshold changing unit for changing the threshold based on physical data expressing a physical feature of the user and registering the changed threshold in the storing unit, and a discriminating unit for discriminating whether a detected physical activity is walking or running by comparing a value of a parameter calculated from amplitude and cycle of an output signal of the acceleration sensor with the threshold.

The "physical data expressing a physical feature" refers to a feature which can exert an influence on a body motion (particularly, the pitch and stride of walking and running) among features of the user. Typically, data expressing physical attributes such as "height", "weight", and "length of leg" corresponds to the physical data. Since "sex", "age", and the like also exert an influence on the basic physical ability, they can be also used as the physical data. The physical data may not be one kind of data but may be a combination of a plurality of kinds of data (for example, a combination of height and weight or a combination of height, sex, and age).

According to the present invention, by changing (adjusting) a threshold for discriminating between walking and running from each other based on the physical data of the user, differences among individuals such as differences in physical attributes and physical ability can be absorbed, and walking and running can be discriminated precisely from each other.

Since the very simple process of comparing the value of the parameter calculated from the amplitude and cycle with the threshold is performed, there is also an advantage that the calculation amount can be reduced. Further, there is also an advantage that it is sufficient to change the threshold, and a calculator (program or circuit) of the parameter is commonly used. Those advantages contribute to miniaturization of an arithmetic circuit, reduction in cost, and power saving.

In the present invention, preferably, individual thresholds can be registered in the storing unit for a plurality of users. With the arrangement, the apparatus can be commonly used by the plurality of users. Moreover, by using an individual threshold for each user, walking and running of all of users can be discriminated from each other with high precision.

As a parameter, a value obtained by dividing one of the amplitude and the cycle by the other can be preferably used. There is a tendency that the amplitude is larger and the cycle is smaller during running than those during walking. By dividing one of the amplitude and the cycle by the other, the tendency is increased. Thus, walking and running can be discriminated from each other more easily.

A second aspect of the present invention relates to a body motion discriminating apparatus including an acceleration sensor for detecting a body motion of a user, a storing unit for storing a threshold, a discriminating unit for discriminating whether a detected body motion is walking or running by comparing a value of a parameter calculated from amplitude and cycle of an output signal of the acceleration sensor with the threshold, and a correcting unit for correcting at least one of the value of the parameter and the threshold, which are used for the comparison, based on physical data expressing a physical feature of the user.

In the first aspect, a preliminarily changed threshold is registered in the storing unit. In contrast, in the second aspect, at the time of the discriminating process, the value of the parameter and/or the threshold are dynamically corrected. With the configuration as well, differences among individuals such as differences in physical attributes and physical ability can be absorbed, and walking and running can be discriminated from each other with high precision.

A third aspect of the present invention relates to an activity monitor including: the above-described body motion discriminating apparatus according to the present invention; and a calculating unit for calculating a quantity and/or an intensity of the detected body motion based on an output signal of the acceleration sensor and a discrimination result of the body motion discriminating apparatus.

With the body motion discriminating apparatus of the present invention, walking and running can be discriminated from each other with high precision. Consequently, the quantity of physical activity (such as energy expenditure) and the intensity of physical activity (such as METs) can be accurately calculated according to the discrimination result.

According to the present invention, walking and running can be discriminated from each other with high precision from an output signal of the acceleration sensor in consideration of individual differences such as differences in physical attributes.

DESCRIPTION OF THE EMBODIMENTS

Preferred embodiments of the present invention will be illustratively specifically described below with reference to the drawings. An example of applying a body motion discriminating apparatus of the present invention to an activity monitor will be described.

<Configuration of Activity Monitor>

Figure 1:
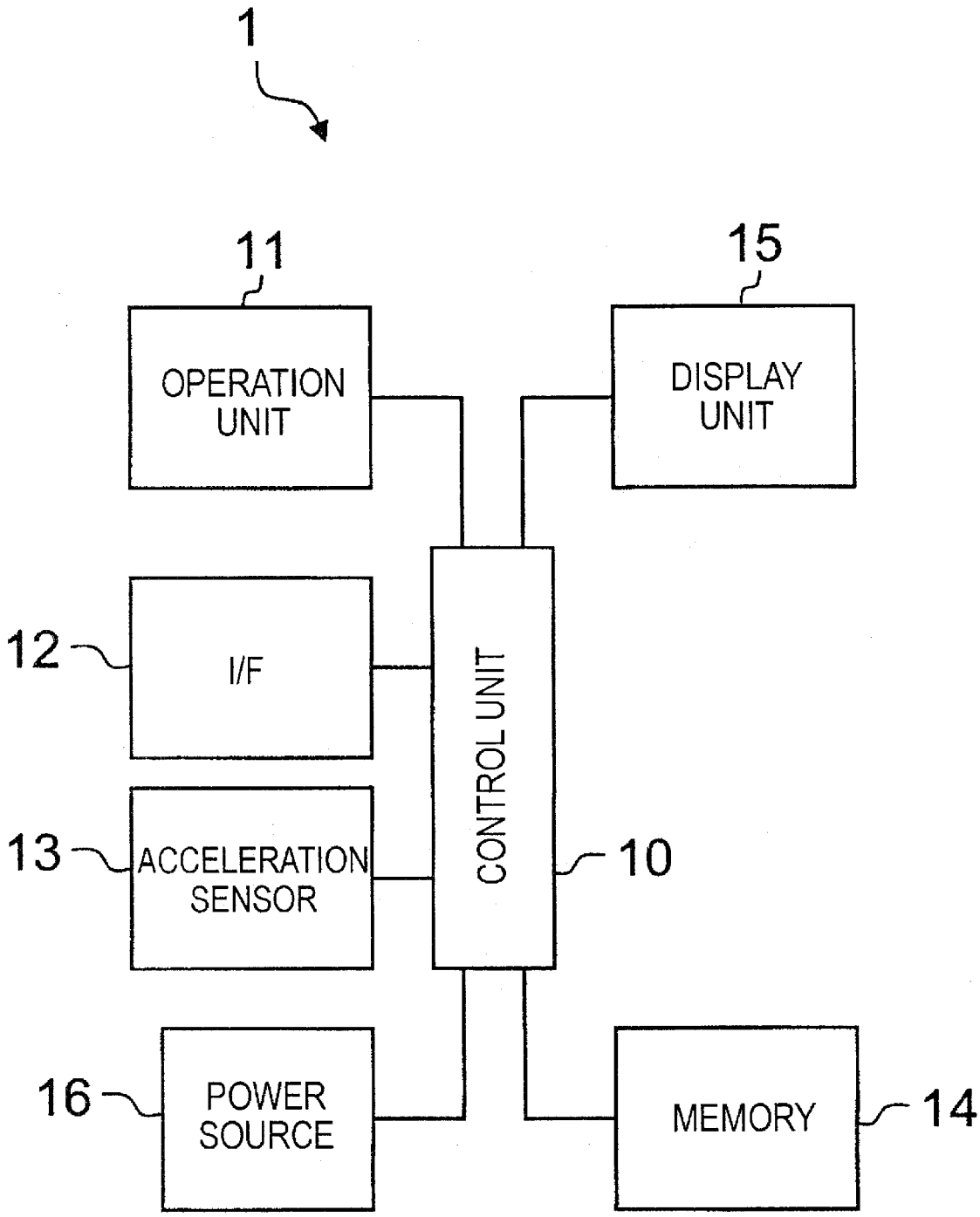
FIG. 1 is a block diagram showing the internal configuration of an activity monitor.

FIG. 1 is a block diagram showing the internal configuration of an activity monitor. An activity monitor 1 includes a control unit 10, an operation unit 11, an I/F 12, an acceleration sensor 13, a memory 14, a display unit 15, and a power source 16.

The control unit 10 is constructed by a microprocessor, an FPGA (Field Programmable Gate Array), or the like and plays the role of executing various computing processes such as detection of a body motion, discrimination of the kind (walking or running) of the a body motion, calculation and recording of the quantity and/or intensity of the body motion, and display of an exercise achievement, and control of the display unit 15, and the like according to the pre-stored program. The details of the function of the control unit 10 will be described later.

The operation unit 11 is a user interface for performing operations such as setting of a goal, resetting of the number of steps and display, and entry of various setting values. The operation unit 11 also performs operations such as registration of a user and entry of physical data (height, weight, sex, age, and the like). The I/F 12 is an external interface for transmitting/receiving data to/from an external device such as a body composition meter or a personal computer by wireless communication or wired communication. The memory 14 is nonvolatile storing means for recording the number of steps, the quantity of physical activity, the intensity of physical activity, and the like and storing information of a user (including physical data), and data such as various setting values (including threshold for discrimination) used by a program. The display unit 15 is display means constructed by an LCD (liquid crystal display) or the like and can display information such as the number of steps, the quantity of physical activity, the intensity of physical activity, the degree of attainment of a goal, and the like.

<Acceleration Sensor>

The acceleration sensor 13 is a detecting unit for detecting a body motion of a user. A uniaxial acceleration sensor or a multiaxial acceleration sensor may be used. However, to precisely detect a motion in the vertical direction, preferably, at least one axis is disposed in the vertical direction. As the acceleration sensor 13, a sensor of any principle such as a capacitive sensor or a piezoelectric sensor can be used.

A raw signal output from the acceleration sensor 13 includes low-frequency components corresponding to fluctuations in gravitational acceleration (static acceleration). It is consequently sufficient to eliminate low-frequency components by using a high-pass filter and extract only components of dynamic acceleration of a body motion (walking or running) of the user. By using such an output signal, accurate discrimination of a body motion and accurate calculation of a quantity of physical activity and an intensity of physical intensity can be performed. In the case of using a sensor of a type which detects only a change in the dynamic acceleration, the configuration such as the above-described high-pass filter is unnecessary.

<Discrimination Between Walking and Running>

Figure 2:
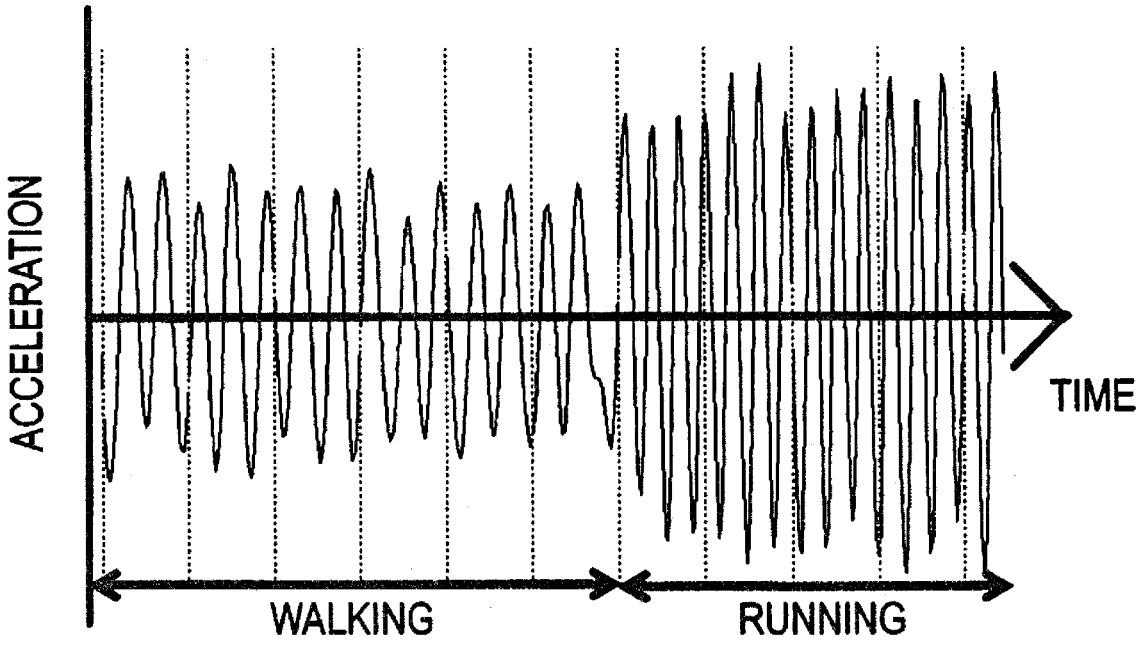
FIG. 2 is a diagram showing an example of the waveform of an output signal of an acceleration sensor.

FIG. 2 shows an example of the waveform of an output signal obtained from the acceleration sensor 13. The horizontal axis indicates time, and the vertical axis indicates the magnitude of acceleration. The first half shows the waveforms at the time of walking. The latter half shows waveforms at the time of running. It is understood that when the activity type changes from walking to running, the pitch becomes higher (the cycle becomes smaller) and the amplitude increases.

Such a tendency appears commonly to all of people. Therefore, by evaluating changes in the cycle and amplitude of the output signal waveform, there is the possibility that walking and running can be discriminated from each other. However, the values of the cycle and amplitude at the time when the activity type changes from walking to running vary among individuals. It is therefore difficult to precisely discriminate walking and running of all of users using a uniform threshold (or a uniform discriminant).

Figure 3:
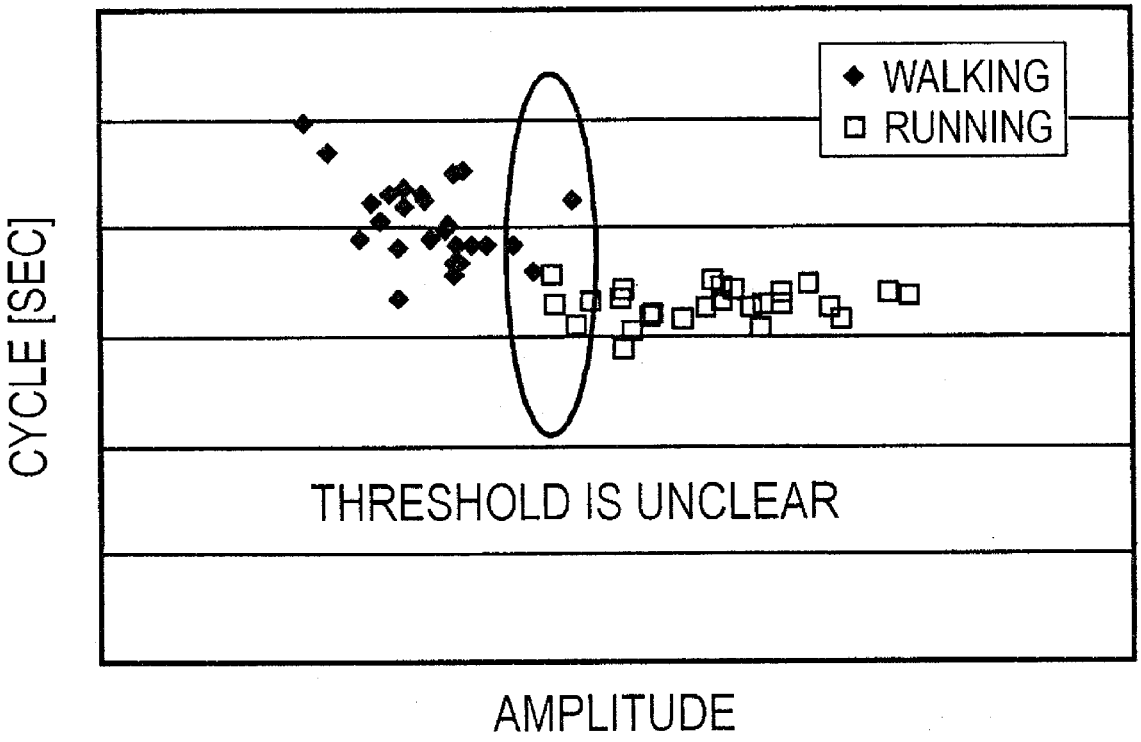
FIG. 3 is a scatter diagram showing a result of an experiment conducted on a plurality of subjects.

FIG. 3 is a scatter diagram showing a result of an experiment conducted on a plurality of subjects. The horizontal axis indicates amplitude, and the vertical axis indicates cycle. Solid diamonds express "walking", and blank squares express "running". In the experiment, the walking speed was gradually increased in a treadmill, and a change from walking to running was determined by a visual check. In the scatter diagram of FIG. 3, the amplitude and cycle at the time of a change from walking to running are plotted as "running". As understood from FIG. 3, the border between walking and running is unclear (points of walking and points of running mixedly exist). Even when attention is paid to any one of the cycle and amplitude, it is difficult to set a threshold for discriminating walking and running from each other.

The inventors of the present invention have earnestly made examinations and experiments in consideration of the above-described point, and found out that there is a high correlation between the cycle at the time of a change from walking to running (hereinbelow, referred to as "running start cycle") and physical attributes (such as height, weight, and length of legs). They also found out that individual attributes such as sex and age exerting an influence on the basic individual physical ability also have a relation with the value of the running start cycle. In the following, features which can exert an influence on a body motion (particularly, the pitch and stride of walking and running) among features (attributes) of a user will be generically referred to as physical data expressing physical features of the user.

Figure 4:
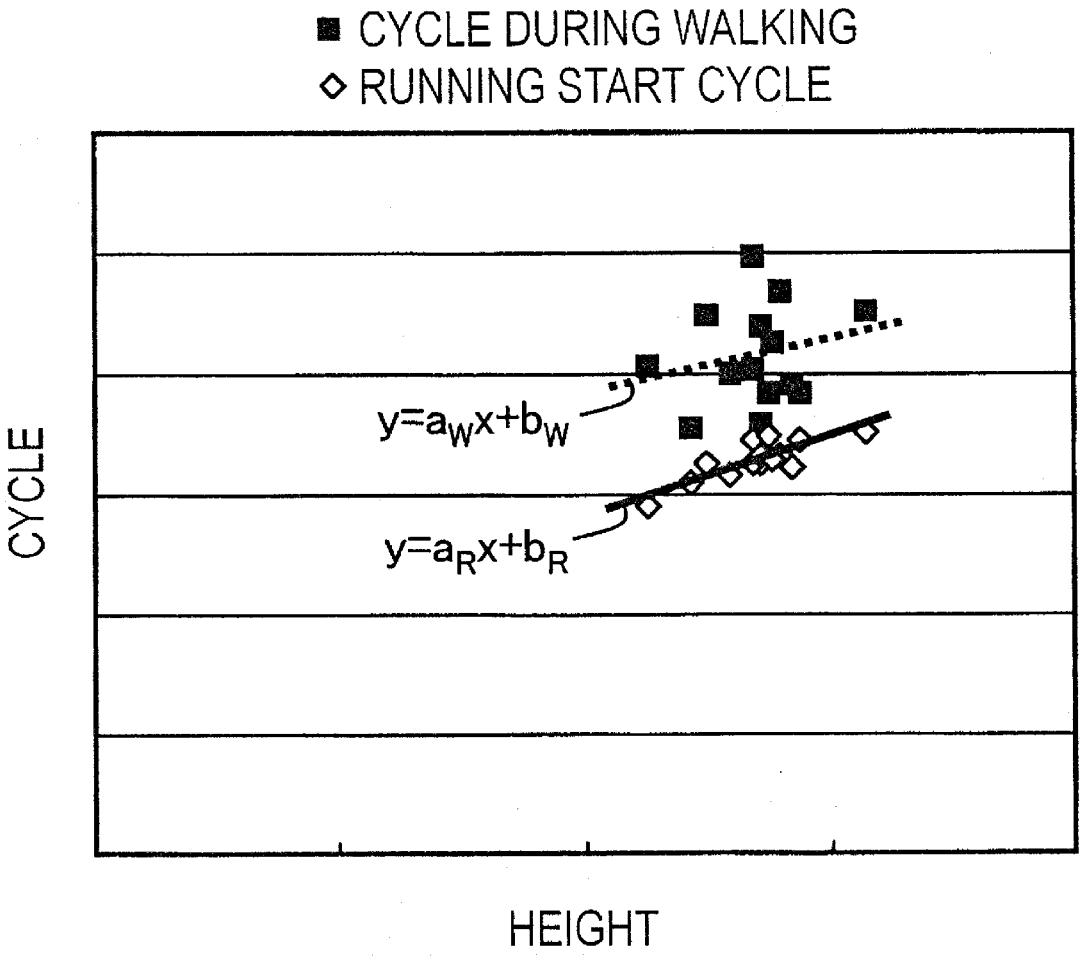
FIG. 4 is a scatter diagram showing the correlation between height and cycle.

As an example of physical data, the correlation between height and the cycle will be described. FIG. 4 is a scatter diagram showing the correlation between height and the cycle. The horizontal axis indicates height, and the vertical axis indicates cycle. Solid squares express "cycle during walking", and blank diamonds express "running start cycle". It is understood that although there is hardly a correlation between height and the cycle during walking, the running start cycle has a high correlation with height. A regression line $y=ax+b$ was derived from the experiment result of FIG. 4. A correlation coefficient ($R^2$) of the cycle during walking was about 0.05, and a correlation coefficient of the running start cycle was about 0.68. It could be confirmed that there is a very high correlation between height and the running start cycle. By using a regression line (coefficients: $a_R$, $b_R$) obtained here, the value "y" of the running start cycle of the user can be estimated from height "x".

The running start cycle obtained as described above satisfies the following relations.

Cycle during walking>running start cycle>cycle during running

Therefore, when the output signal of the acceleration sensor is obtained, by correcting the amplitude as follows, amplitude after correction=measured amplitude×(running start cycle÷measured cycle), in the case of walking, the corrected amplitude becomes a value smaller than the actually measured amplitude because (running start cycle÷measured cycle)<1, and in the case of running, the corrected amplitude becomes a value larger than the actually measured amplitude because (running start cycle÷measured cycle)≧1.

Therefore, the difference between the amplitude during walking and the amplitude during running is emphasized, so that walking and running can be discriminated from each other more easily.

Figure 5A:
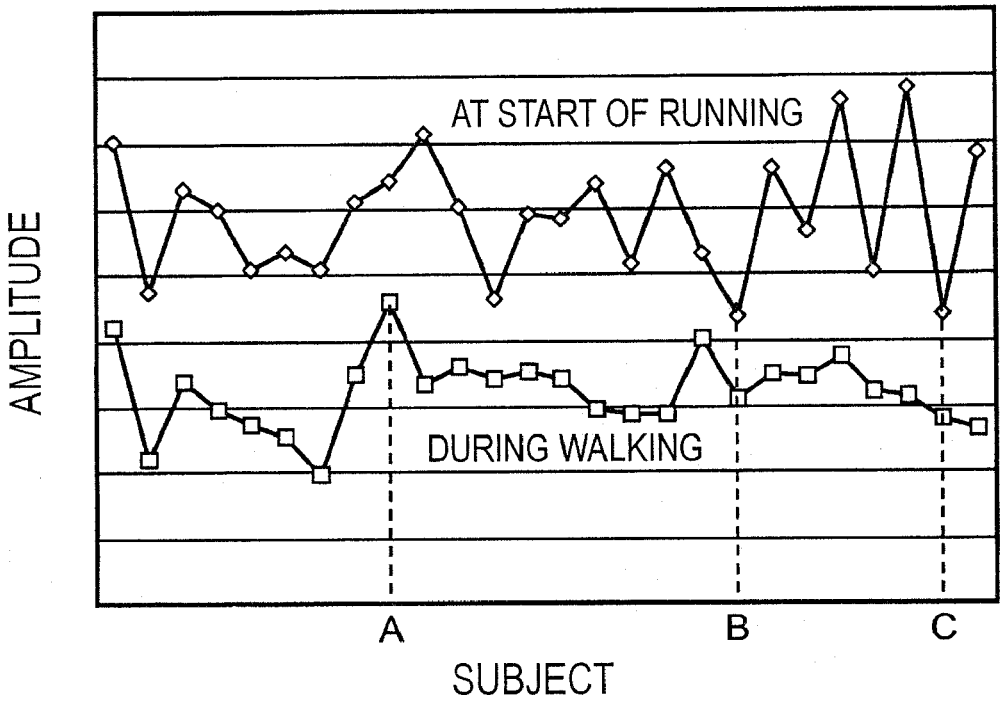
FIG. 5A is a graph on which amplitudes during walking and at the start of running of a plurality of subjects are plotted.

FIG. 5A is a graph on which amplitudes during walking and at the start of running of a plurality of subjects are plotted. The upper side shows a graph at the start of running, and the lower side shows a graph during walking. The amplitudes during running are plotted upper than those at the start of running (not shown). As understood from FIG. 5A, there are individual differences in both of the amplitude during walking and the amplitude at the start of running. The amplitude during walking of a subject A is larger than the amplitude at the start of running of each of subjects B and C. Therefore, in this case, walking and running of all of subjects cannot be discriminated with one threshold.

Figure 5B:
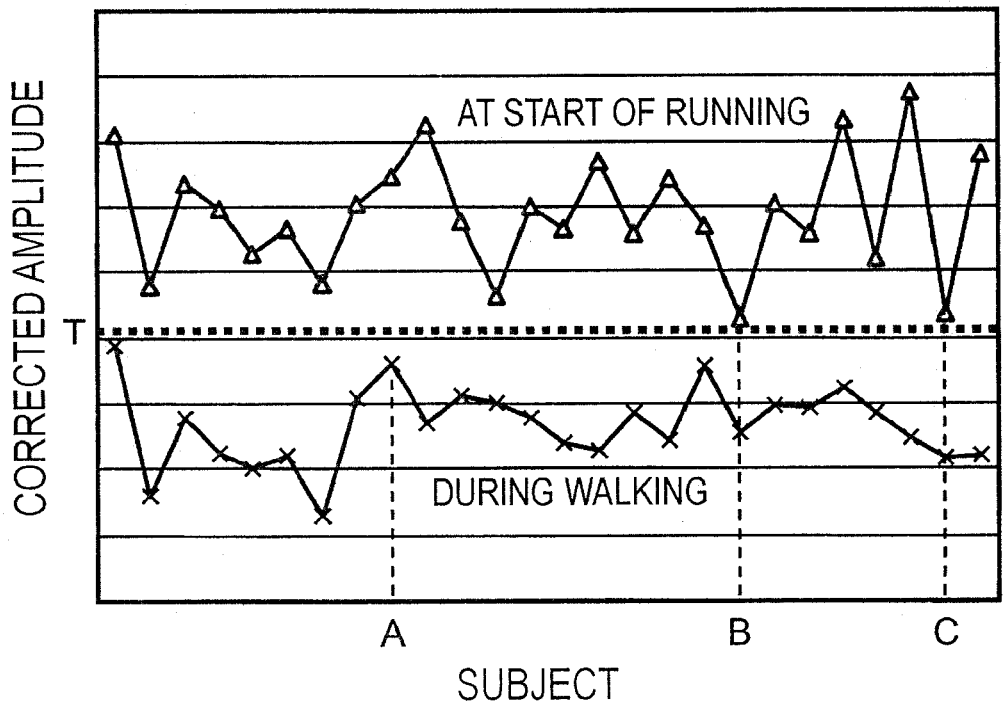
FIG. 5B is a graph on which corrected amplitudes are plotted.

FIG. 5B is a graph on which corrected amplitudes are plotted. It is understood that the amplitudes during walking are smaller in whole. There is hardly any change in the amplitude at the start of running for the reason that the "running start cycle" and the "measured cycle" become almost equal to each other in the correction formula above. The amplitudes during running (not shown) are large in whole. It is understood from the corrected amplitudes in FIG. 5B that the amplitude during walking of the subject A is smaller than the amplitude at the start of running of each of the subjects B and C. In this case, therefore, walking and running of all of subjects can be discriminated from one another with one threshold T.

That is, the following discriminant is satisfied.

Threshold $T$<measured amplitude×(running start cycle÷measured cycle)→running

The others→walking

By modifying the discriminant, the following discriminant is obtained.

Threshold $Tx$>measured cycle÷measured amplitude→running

The others→walking where threshold $Tx$=running start cycle÷threshold $T$

The threshold Tx can be obtained from the value of T preliminarily obtained by an experiment on subjects and the running start cycle calculated from the height of the user of the activity monitor. The right side of the discriminant (a parameter for discrimination) can be obtained from an output signal from the acceleration sensor. There is a tendency that the amplitude during running is larger than the amplitude during walking and the cycle during running is smaller than the cycle during walking. By using a parameter obtained by dividing one of the amplitude and the cycle by the other as described above, the tendency is increased. Thus, walking and running can be discriminated from each other more easily.

<Operation of Activity Monitor>

Figure 6:
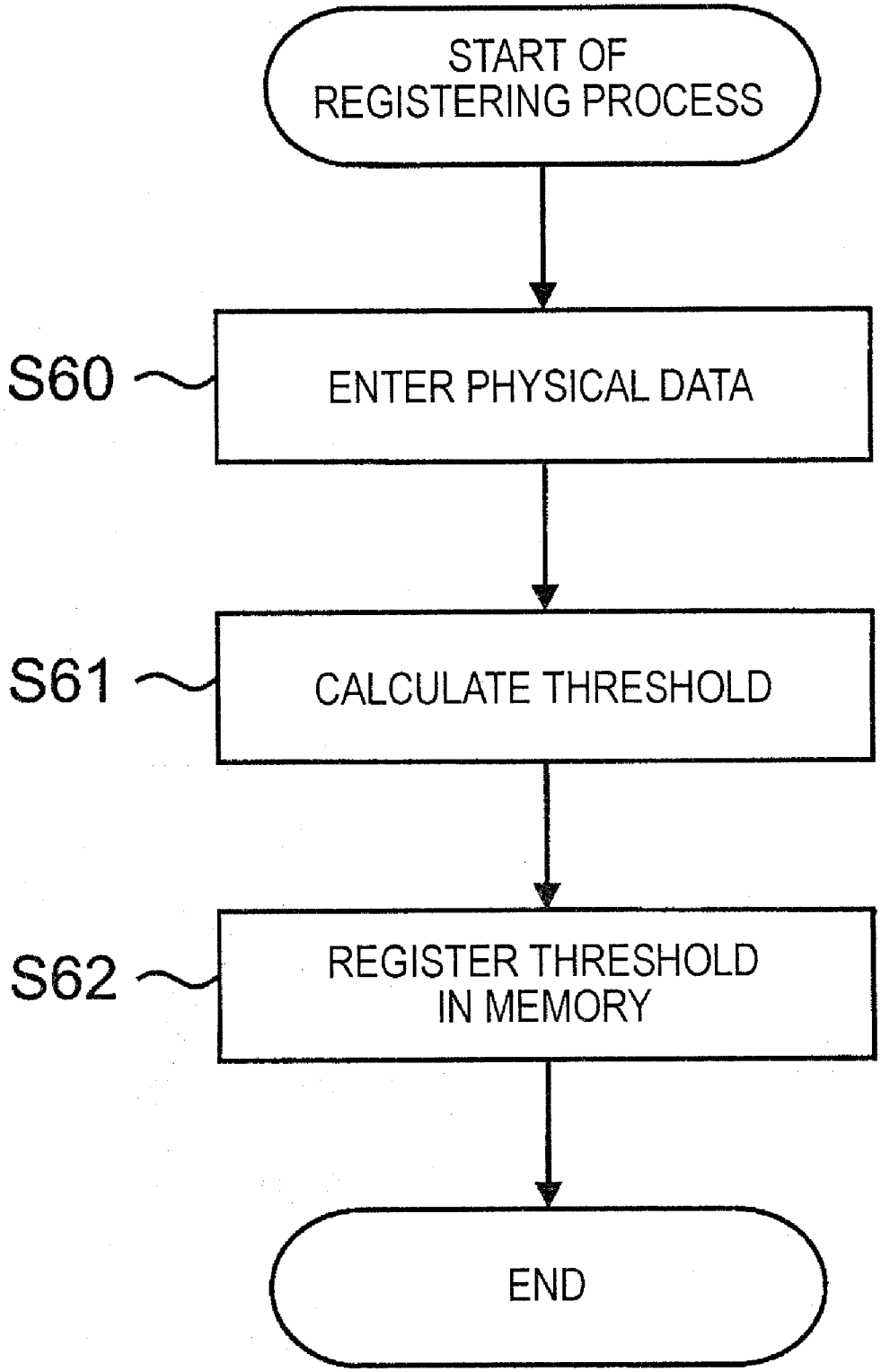
FIG. 6 is a flowchart of a user registering process.

FIG. 6 is a flowchart of a user registering process. The registering process is executed only once at the time of registering a new user.

When a user enters height from the operation unit 11 (S60), the control unit 10 calculates the threshold Tx of the user from the input height and the values of coefficients $a_R$, $b_R$, and T which are pre-stored in the memory 14 by the following equation (S61).

Threshold $Tx=(a_R\times\text{height}+b_R)\div T$

The calculated threshold Tx is registered in the memory 14 (S62). After that, when the user uses the activity monitor, the threshold Tx registered in the memory 14 is used.

In the activity monitor, a plurality of users can be registered. In this case, a threshold can be individually registered for each user in the memory 14. At the time of using the activity monitor, by entering the ID of the user from the operation unit 11, his proper threshold is read.

Figure 7:
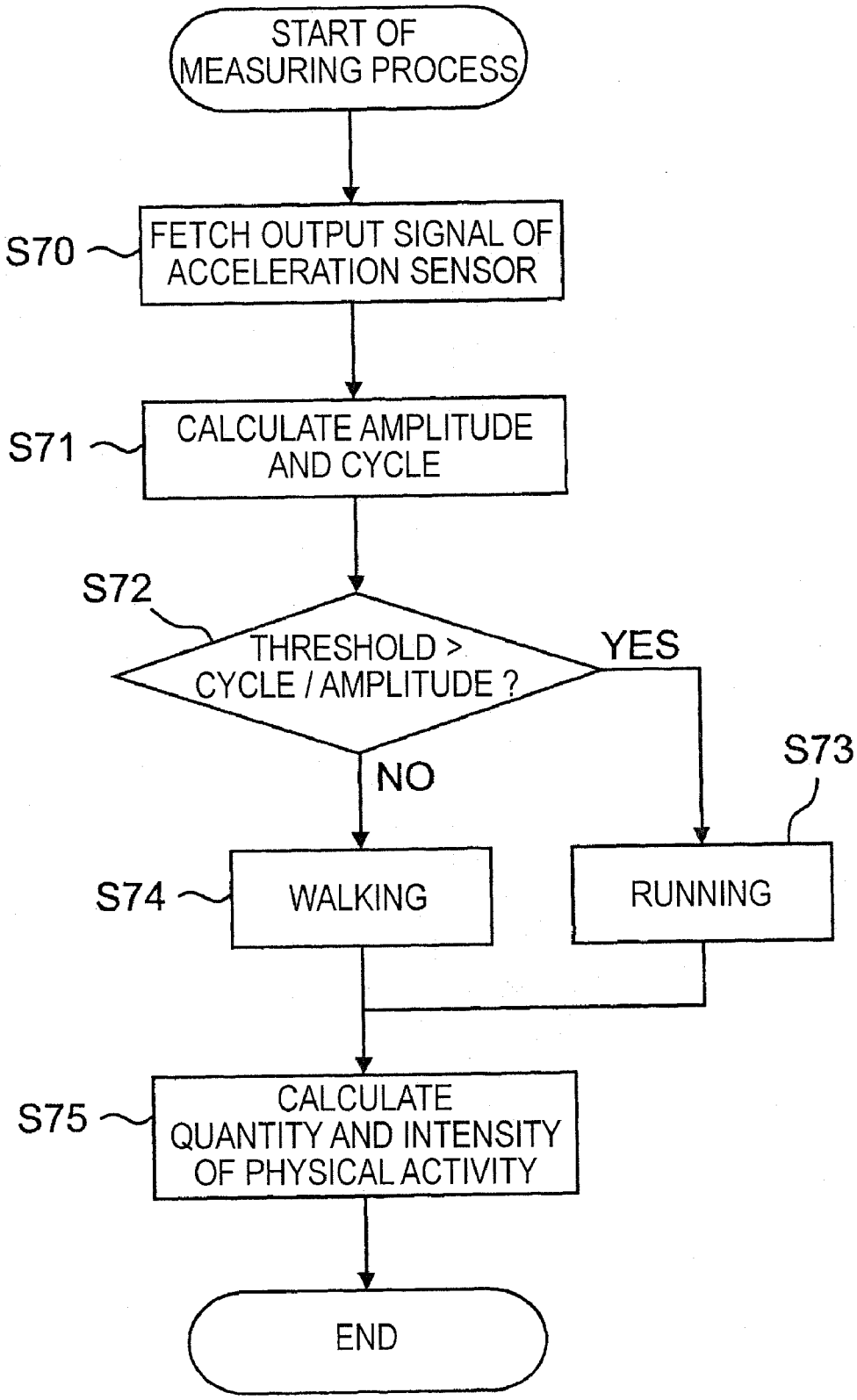
FIG. 7 is a flowchart of a measuring process.

FIG. 7 is a flowchart of the measuring process. The flow of the measuring process is repeated in a predetermined period such as a few seconds or ten-odd seconds.

When output signal waveforms for one period from the acceleration sensor 13 are fetched in the control unit 10 (S70), the amplitude and the cycle of the waveform are calculated (S71). In this process, an average amplitude and an average cycle are calculated. The control unit 10 calculates a discrimination parameter "cycle÷amplitude" from the amplitude and the cycle obtained in S71 and compares the value of the parameter with the threshold Tx (S72). In the case where the value of the parameter is smaller than the threshold Tx, a body motion for this period is determined as "running" (S73). In the other cases, the physical activity is determined as "walking" (S74). The determination result is used for calculation of the quantity and intensity of the physical activity (S75).

In the above-described configuration, by changing (adjusting) the threshold Tx for discriminating walking and running from each other based on the physical data of the user, differences among individuals such as differences in physical attributes and physical ability can be absorbed, and walking and running can be precisely discriminated from each other.

Since the very simple process of comparing the value of the parameter calculated from the amplitude and cycle with the threshold is performed, there is also an advantage that the calculation amount can be reduced. There is also an advantage that it is sufficient to change the threshold, and a calculator (program or circuit) of the parameter can be commonly used. Those advantages contribute to miniaturization of an arithmetic circuit, reduction in cost, and power saving.

Since the threshold can be registered for each user, one activity monitor can be commonly used by a plurality of users. Moreover, by using an individual threshold for each user, walking and running of all of users can be discriminated from each other with high precision.

Since walking and running can be precisely discriminated from each other, a quantity of physical activity (such as energy expenditure, burnt calories) and an intensity of physical activity (such as METs) can be calculated more accurately.

<Modifications>

The configuration of the foregoing embodiment is just a concrete example of the present invention. The scope of the present invention is not limited to the foregoing embodiment but can be variously modified within the technical idea of the present invention.

For example, although height is used as physical data in the foregoing embodiment, a proper threshold can be also similarly determined by using data such as weight or length of a leg. Further, it is also preferable to make the coefficients (a, b, and T) used for calculating the threshold vary and/or to correct a calculated threshold, according to sex and age. It is also preferable to use a plurality of kinds of physical data at the time of determining a threshold.

In the foregoing embodiment, a threshold for each user is registered in a memory and, at the time of the measuring process (discriminating process), the threshold is used. However, it is also possible to register only physical data in the memory and, at the time of the measuring process (discriminating process), dynamically correct the value of the parameter and/or the value of the threshold based on the physical data. In this case, correction calculation is necessary for every measuring process, so that there is a disadvantage that the calculation amount increases. However, similarly to the foregoing embodiment precise discrimination can be realized.

What is claimed is:

1. A body motion discriminating apparatus comprising:

an acceleration sensor for detecting a body motion of a user;

a storing unit for storing a threshold;

a threshold changing unit for changing the threshold based on physical data expressing a physical feature of the user and registering the changed threshold in the storing unit; and a discriminating unit for discriminating whether a detected body motion is walking or running by comparing a value of a parameter calculated from amplitude and cycle of an output signal of the acceleration sensor with the threshold.

2. The body motion discriminating apparatus according to claim 1, wherein the physical data is height and/or weight.

3. The body motion discriminating apparatus according to claim 1, wherein individual thresholds for a plurality of users can be registered in the storing unit.

4. The body motion discriminating apparatus according to claim 1, wherein the parameter is obtained by dividing one of amplitude and cycle by the other.

5. An activity monitor comprising:

the body motion discriminating apparatus of claim 1; and a calculating unit for calculating a quantity and/or an intensity of the detected physical activity based on an output signal of the acceleration sensor and a discrimination result of the body motion discriminating apparatus.

6. A body motion discriminating apparatus comprising:

an acceleration sensor for detecting a body motion of a user;

a storing unit for storing a threshold;

a discriminating unit for discriminating whether a detected body motion is walking or running by comparing a value of a parameter calculated from amplitude and cycle of an output signal of the acceleration sensor with the threshold; and a correcting unit for correcting at least one of the value of the parameter and the threshold, which are used for the comparison, based on physical data expressing a physical feature of the user.

7. An activity monitor comprising:

the body motion discriminating apparatus of claim 6; and a calculating unit for calculating a quantity and/or an intensity of the detected physical activity based on an output signal of the acceleration sensor and a discrimination result of the body motion discriminating apparatus.

* * * * *